United States Patent [19]

Dudko et al.

[11] 4,258,091

[45] Mar. 24, 1981

[54] METHOD FOR COATING

[76] Inventors: Daniil A. Dudko, ulitsa Anri Barbjusa, 22/26; Anatoly I. Zverev, ulitsa Bratislavskaya, 26, kv. 22; Evgeny A. Astakhov, ulitsa Vyborgskaya, 89-a kv. 46, all of Kiev; Georgy G. Pulyaevsky, ulitsa B. Bronnaya, 26, kv. 23, Moscow, all of U.S.S.R.

[21] Appl. No.: 9,947

[22] Filed: Feb. 6, 1979

[51] Int. Cl.[3] ..... B05D 1/08

[52] U.S. Cl. ..... 427/422; 239/1; 239/8; 239/79; 239/81; 427/423

[58] Field of Search ..... 427/423, 422, 34, 191, 427/376 H; 428/937; 239/1, 8, 79, 81

[56] References Cited

U.S. PATENT DOCUMENTS

| | | | |
|---|---|---|---|
| 2,774,625 | 12/1956 | Hawley et al. | 239/81 X |
| 2,869,924 | 1/1959 | McGill | 239/81 |
| 2,950,867 | 8/1960 | Hawley et al. | 239/79 X |
| 3,150,828 | 9/1964 | Pelton et al. | 239/79 |
| 3,773,259 | 11/1973 | Zuerev | 239/81 |
| 3,884,415 | 5/1975 | Zuerev et al. | 239/79 |

FOREIGN PATENT DOCUMENTS

| | | | |
|---|---|---|---|
| 636847 | 2/1962 | Canada | 427/423 |
| 791705 | 3/1958 | United Kingdom | 427/423 |
| 1517679 | 7/1978 | United Kingdom | 239/81 |

*Primary Examiner*—Shrive P. Beck
*Attorney, Agent, or Firm*—Holman & Stern

[57] ABSTRACT

A coating is applied to a workpiece by ejecting a powdered material towards the workpiece using the energy of explosion in a recurrent cyclical operation. To produce an explosion, introduced into a combustion chamber of a detonation gun are a powdered coating material suspended in the stream of an inert gas and a gaseous explosive mixture formed by mixing a combustible gas and an oxidizing gas with or without an addition of an inert gas. During the coating process the explosive mixture is formed continuously, and cyclically filling the combustion chamber by portions of the explosive mixture is accomplished by feeding the inert gas to the pipe connecting the mixing chamber to the combustion chamber, which enables regular termination of the stream of explosive mixture and prevents the flame from spreading to the mixing chamber.

1 Claim, 5 Drawing Figures

METHOD FOR COATING

BACKGROUND OF THE INVENTION

1. Field of the Invention

The present invention relates to coating techniques and, more particularly, to a method of applying a coating by virtue of the energy of explosion for ejecting a powdered material towards a workpiece in recurrent cyclic operation.

This invention can be employed for coating surfaces of various materials with a view to protecting them against corrosion and mechanical effects. Metals, refractory compounds and materials based thereon, such as hard alloys etc., can be utilized as a coating material.

2. Description of the Prior Art

In general, methods of coating by virtue of explosive energy, particularly the energy of detonation waves, comprise preparing explosive mixture composed of a combustible gas, an oxidizing gas (as a rule acetylene and oxygen), and a gaseous suspension consisting of a powdered coating material and an inert carrier gas, supplying the explosive mixture and gaseous suspension to a combustion chamber which is a part of an elongated barrel having a closed end, and igniting the explosive mixture after said chamber is filled and the supply of said ingredients is cut off. The explosive energy is transmitted to the particles of powdered coating material which are suspended in the gaseous explosive mixture. As a result of the explosion, the heated and accelerated particles are blown out from the open end of the barrel at a great velocity towards the workpiece. Upon striking the workpiece surface, the particles of the coating material form a coated spot.

During the coating process, devices for accomplishing said methods (usually referred to as "detonation guns") are kept stationary, while the workpiece, placed at a certain distance from the open end of the detonation gun barrel, is moved perpendicularly relative to said barrel axis by means of any suitable device, for instance a manipulator. The speed and direction of the workpiece movement relative to the open end of the detonation gun are determined by the detonation rate of the gun and the required thickness of coating. Alternatively, the workpiece may remain immovable while the detonation gun is moved perpendicular to, and at a certain distance from, the workpiece surface.

One of the main disadvantages which makes impossible a wide application of coating methods using detonation waves is the generally accepted way of preparing the explosive mixture for each individual cycle. To carry out this operation, a complex gas distributing apparatus is usually employed for cyclically filling a mixing chamber and/or a combustion chamber with portions of the explosive mixture.

During the cyclical coating process all the operations proceed within several milliseconds, and even the slightest difference in the time of opening of the valves, through which combustible gas and oxidizing gas are introduced, adversely affects the quality of the explosive mixture, that is, the optimum quantitative ratio of the components of the mixture may not be maintained. In addition, the above time interval may prove to be insufficient for homogenizing an individually prepared portion of the explosion mixture.

These factors disturb the stability of the coating process and worsen the quality of coating. Thus, a variable quantitative ratio of the components of the explosive mixture causes temperature fluctuations and changes in the ejection velocity of the detonation products and powdered coating material. For this reason there is observed a marked scattering of values of technical coating indices in each particular spot. Said disadvantage is increased even more due to the fact that particles of the powdered coating material are heated unevenly in each cycle as a result of the explosion heterogeneity of the explosive mixture. A method of coating is described in U.S. Pat. No. 2,950,867 which employs the energy of explosion for ejecting a powdered coating material towards a workpiece in a recurrent cyclic operation. This method comprises preparing portions of an explosive mixture of acetylene and oxygen within a combustion chamber of the coating apparatus, introducing a powdered coating material into said chamber in the form of a gaseous suspension which employs an inert carrier gas, and igniting the explosive mixture immediately after a portion of the powdered coating material has been completely injected into the combustion chamber.

The apparatus for coating by detonation waves, employed in carrying out the aforedescribed method, includes a complicated gas distributing apparatus and a combustion chamber having poppet valves connected to a cam mechanism provided for opening and closing the valves in accordance with the predetermined rate of operation.

All the aforementioned disadvantages are inherent in the above-described method. Thus, for instance, fluctuation of concentration of the ingredients of the explosive mixture amounts to 46% in various zones of the combustion chamber. The heterogeneity and variation of the quantitative composition of the explosive mixture for above reasons, cause heterogeneity of the coating structure and variation in the strength of the coating layer and, in some places, in adhesion between the coating material and the workpiece material.

SUMMARY OF THE INVENTION

A principal object of the present invention is a method of coating capable of an improved quality coating.

Another object of the invention is a method of coating, capable of a more accurate metering of the components of an explosive mixture.

Still another object of the invention is a method of coating, capable of homogeneity of providing the explosive mixture in all zones of the combustion chamber.

A further object of the invention is a method of coating, which is capable of increasing the reliability of the equipment used in coating by means of detonation waves.

It is also an object of the invention to provide a method for coating, wherein simple equipment is required to achieve the purpose.

These objects are attained by this invention which comprises a method of coating using explosive energy for ejecting a powdered material towards a workpiece in a recurrent cyclic operation, by means of steps comprising: (a) into a combustion chamber a mixture of a combustible gas and an oxidizing gas having a ration predetermined to form an explosive mixture, (b) injecting into said combustion chamber by portions, the powdered coating material in the stream of an inert gas, said injection of the powdered material and explosion mixture being synchronized with an operation cycle, (c)

igniting the explosive mixture in the combustion chamber to produce an explosion after a portion of the powdered coating material is completely introduced into said chamber, and wherein, according to the invention, the combustible and oxidizing gas are continuously and constantly fed during the coating process and the stream of the explosive mixture is terminated prior to ignition in the combustion chamber.

Continuously feeding the combustible and inert gas, that is, feeding thereof under the conditions of stable and stationary operation, makes it possible to eliminate variations in concentration of the components of the explosive mixture and ensures the homogeneity of the explosive mixture and uniformity of its quantitative composition.

Employing the aforedescribed method for coating makes it possible, to ensure cyclical ejection of the powdered material, to feed a homogeneous mixture of a combustible gas and oxidizing gas to the combustion chamber with a uniform quantitative ratio of said components of the mixture. As a result, the quality of coating is improved.

Termination of the explosive mixture can be accomplished by means of any conventional device, for instance by a slide-valve intended specifically for the purpose, providing that the explosive mixture stream is cut off external to the combustion chamber.

To simplify the equipment for coating by means of detonation waves and to increase its reliability, the stream of explosive mixture supplied to the combustion chamber can be terminated by feeding a neutral gas.

BRIEF DESCRIPTION OF THE DRAWINGS

The invention will now be described with reference to the accompanying drawings illustrating a specific embodiment thereof, wherein.

DETAILED DESCRIPTION OF THE INVENTION

Figure 1:
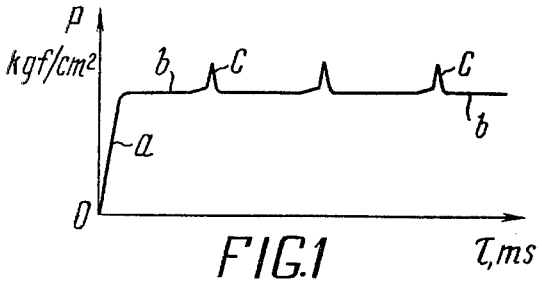
FIG. 1 is a diagram of the pressure variation in the pipes through which components of the explosive mixture are fed during the process of coating by detonation, according to the invention.

As may be observed from the diagram (FIG. 1) of pressure variation in the pipes supplying the components of the explosive mixture in the course of carrying out the method of coating according to the invention, at a time, $\tau=0$, corresponding to the moment of starting up the apparatus for carrying out said method, a pressure "P" increases sharply from zero to a predetermined magnitude (as shown by the portion a of the curve). As the section of said apparatus in which the explosive mixture is continuously formed is filled, the pressure in the pipes through which the ingredients of the mixture are fed, stabilizes at a level b close to a predetermined magnitude. At the end of each detonation cycle, as a result of terminating a portion of the explosive mixture and a sharp increase of back pressure caused by detonation, said pressure in supply pipes increases abruptly by a small value (as shown by the peak C in FIG. 1) and then drops again to the predetermined magnitude as the detonation products are flowing out of the barrel.

As seen from the above, the process of preparing explosive mixtures proceeds continuously, and the time required for preparing a homogeneous explosive mixture having a stable ratio of combustible gas to oxidizing gas, does not depend on the duration of a single detonation cycle.

Figure 2:
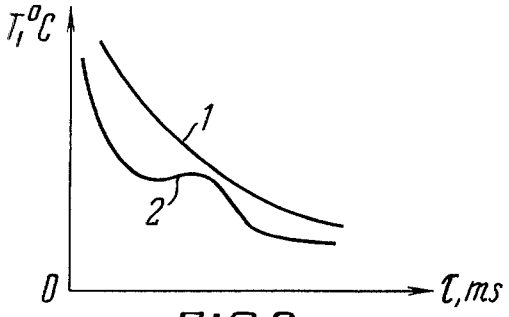
FIG. 2 represents experimental curves illustrating temperature variation, with reference to time, of detonation products at the open end of the barrel as they are ejected from the combustion chamber (curve I shows said dependence of the method according to the invention, whereas curve II, illustrates that for the prior art method)

Shown in FIG. 2 is curve I which illustrates the derived dependence of temperature variation, with reference to time, of the detonation products at the open end of the barrel as the detonation products are being ejected from the combustion chamber in the course of carrying out the method according to the invention. Curve II shows an analogous dependence for the prior-art method.

Comparison of these two curves shows that homogeneity of an explosive mixture, having a stable quantitative ratio of combustible and oxidizing ingredients (curve I), provides for a smooth and gradual decrease of temperature of the detonation products, whereas heterogeneity of the explosive mixture (curve 2) causes a random and abrupt variation of temperature of the detonation products.

Figure 3:
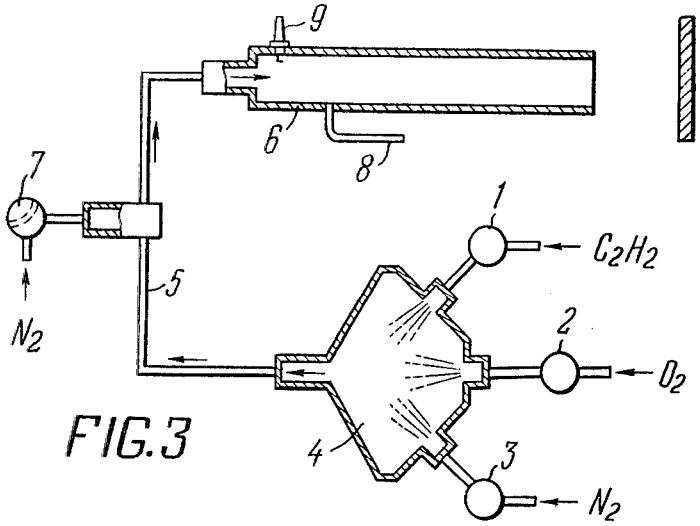
FIG. 3 is a schematic diagram of an alternative embodiment of the apparatus, prior to explosion, according to, and for the purpose of carrying out the method of the present invention.

A basic diagram of apparatus for carrying out the proposed method, shown in FIG. 3, makes it possible to explain graphically the coating process.

At the moment of starting up said apparatus, valves 1, 2 and 3 located respectively on pipes interconnecting a mixing chamber 4 with the sources of acetylene, oxygen and nitrogen are opened, nitrogen being used, if there is a need, to dilute the explosive mixture (sources of said gases are not shown). Said valves remain open throughout the whole coating process up to the moment when the apparatus is shut off.

When the pressure at the inlets of the valves 1 and 2 is kept constant, which can be easily done with adjustment of any suitable means known in the art, the valves 1 and 2 permits acetylene and oxygen to be consumed with the predetermined ratio being optimized for the material selected as a coating material. Accordingly, valve 3 provides for the predetermined rate of nitrogen consumption.

The explosive mixture is formed continuously from of acetylene and oxygen in chamber 4. If necessary, the mixture is diluted in the required proportion by nitrogen. The longer the period of time during which the components of the mixture are in the mixing chamber 4, as compared with the duration of a single explosion, the better is the homogeneity of the mixture.

Individual portions of the explosive mixture are terminated in pipe 5 connecting the mixing chamber 4 with combustion chamber 6 in the detonation gun barrel by intermittently opening valve 7 of the pipe for apportioning an inert gas, for instance nitrogen, the pressure of the inert gas exceeding that of the explosive mixture in that section of pipe 5 which is adjacent to mixing chamber 4.

Figure 4:
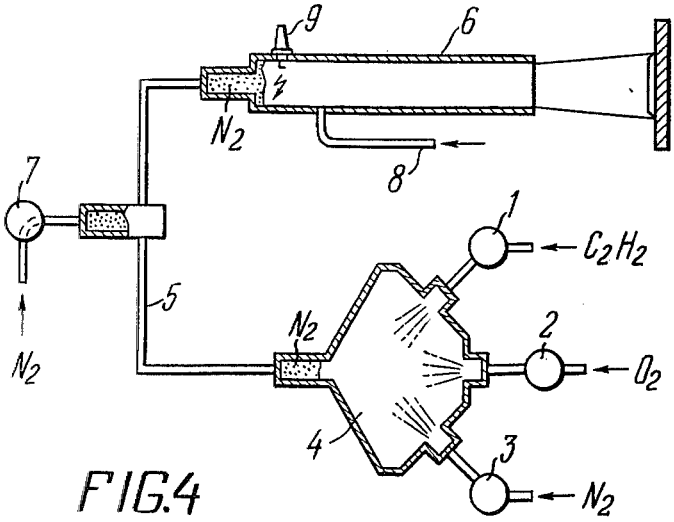
FIG. 4 is the same view as FIG. 3 at the moment of explosion.

When valve 7 (FIG. 4) is operated, a portion of explosive mixture in the pipe 5, between the inert gas supply pipe and the combustion chamber 6, is forced into said chamber. Excessive explosive mixture in pipe 5, between the mixing chamber 4 and the inert gas supply pipe, is forced back into the mixing chamber 4, which is accompanied by an additional increase of pressure in the pipe 5 as a result of detonation of the explosive mixture in the combustion chamber 6.

At the appropriate moment a portion of the powdered material in a stream of inert gas, such as nitrogen, is injected through a branch pipe 8 into a portion of explosion mixture in the combustion chamber 6.

Detonation is caused by means of a spark plug 9.

At the moment of detonation, the mixing chamber 4 and the combustion chamber 6 are separated by a buffer amount of inert gas found in the pipe 5.

It should be pointed out that a certain increase of pressure in the mixing chamber 4, resulting from cutting off a portion of the explosion mixture and detonation of this portion, does not interrupt the formation process of the explosive mixture and actually does not influence the quantitative ratio of acetylene, oxygen and nitrogen, because cyclic and insignificant decrease in their consumption through the valves 1, 2 and 3, coinciding with the detonation rate, takes place synchronously and to the same degree. Moreover, pressure fluctuation in the mixing chamber 4 is conducive to additional homogenizing of the explosive mixture.

An operating cycle of the apparatus is completed by ejection of the detonation products from the detonation gun barrel. At the moment of explosion valve 7 is opened and the pressure in the combustion chamber 6 drops to a magnitude which is less than that in pipe 5, thereby providing for purging of said pipe with neutral gas and, after valve 7 is closed, refilling with the explosive mixture. When the valve 7 is open again, the aforedescribed process is repeated.

The following examples of carrying out the proposed method illustrate its advantages.

EXAMPLE 1

A mixture of acetylene and oxygen in the volume ratio of 1.1 to 1.3, respectively, and finely divided alumina were introduced by portions into the combustion chamber of the apparatus for coating by detonation waves, having a barrel 23 mm in diameter.

Oxygen for the mixture was fed under a pressure of 2.2 to 2.3 kg/sq.cm, and acetylene 2.0 to 2.1 kg/sq.cm. Nitrogen fed under the pressure of 2.0 kg/sq.cm was utilized as an inert gas for preparing gaseous suspension of powdered coating material. For one explosion there were consumed 0.22 lit. of acetylene, 0.27 lit. of oxygen, up to 0.075 lit. of nitrogen forming part of the gaseous suspension, and 150 to 250 mg of alumina. Cyclical filling of the combustion chamber with continuously prepared explosive mixture by portions was effected by feeding nitrogen as a inert gas under a pressure of 3.5 to 3.7 kg/sq.cm just before the explosion mixture was ignited.

A workpiece of titanium to be coated was preliminarily cleaned by methods known in the art and then placed 120–160 mm from an open end of the detonation gun barrel. The detonation rate was 1.8–4.3 times per second.

The thickness of the coating obtained after one explosion was about 7 microns, the strength of cohesion between the coating material and the workpiece material was 4 to 6 kg/sq.mm., Vickers hardness under the load of 50 g was about 1,200 kg/sq.cm, and the porosity did not exceed 2%.

EXAMPLE 2

A mixture of acetylene and oxygen in the volume ratio of 1.0 to 1.2, respectively, to which nitrogen was added in the proportion of 30% of the total volume of said mixture, was introduced into the combustion chamber of the apparatus for coating by detonation waves having a barrel 23 mm in diameter, prior to filling the barrel with explosive mixture. Finely divided hard alloy containing 15% by weight cobalt and 85% by weight tungsten carbide was also fed in the form of a gaseous suspension in nitrogen to the same chamber.

Oxygen, acetylene and nitrogen were introduced under a pressure of 1.9 kg/sq.cm. Nitrogen fed under the pressure of 2.0 kg/sq.cm was used as an inert gas for preparing a gaseous suspension of a powdered coating material.

Portion wise cyclical filling of the combustion chamber with continuously prepared explosive mixture was effected by feeding nitrogen as an inert gas under a pressure of 3.2 to 3.3 kg/sq.cm just before the explosive mixture was ignited.

A workpiece of stainless steel to be coated was preliminarily cleaned by methods known in the art and then placed 170 mm from the open end of a detonation gun barrel. The detonation rate was 1.8 to 4.3 times per second.

The thickness of the coating obtained after one explosion was about 5–8 microns.

Figure 5:
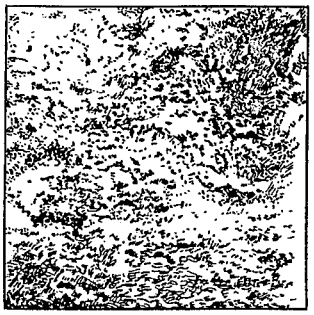
FIG. 5 is a photomicrograph showing a microsection of coating of alumina with an addition of nickel (magnified 300 times).

As can be seen from FIG. 5 the coating has a dense structure. Its porosity is less than 1.5%, and the strength of cohesion with the workpiece material is 17 to 25 kg/sq.mm.

Vickers microhardness under the load of 50 g varied from 1.100 to 1.350 kg/sq.mm.

EXAMPLE 3

A mixture consisting of acetylene, oxygen and nitrogen, and finely divided (2 to 10 microns particle size) chromium carbide in a nitrogen stream were introduced by portions into the combustion chamber of the apparatus described in Examples 1 and 2.

For preparing the mixture oxygen, acetylene and nitrogen were continuously supplied under the pressure of 1.9 kg/sq.cm, the consumption using 0.65 cu.m/h., 0.8 cu.m/h and 2.55 cu.m/h, respectively.

Portion wise cyclical filling of the combustion chamber with said explosive mixture was effected by supplying nitrogen as an inert gas under a pressure of 3.2 to 3.3 kg/sq.cm prior to ignition of the explosive mixture.

A workpiece of titanium alloy to be coated was preliminarily cleaned by methods known in the art and then placed 120 mm from the open end of a detonation gun barrel. The detonation rate was 2 times per second.

The thickness of the coating obtained after one explosion was about 5 microns. The strength of cohesion between the coating material and the workpiece material was about 6 kg/sq.mm, Vickers microhardness under the load of 50 g, was no less than 1,200 kg/sq.mm and porosity not more than 2%.

EXAMPLE 4

A mixture composed of acetylene and oxygen having volume ratio of 1.0 to 1.0, respectively, to which nitrogen was added in the proportion of 34% of the total volume of said mixture, and nickel powder screened through a 225-mesh screen and fed in the nitrogen stream, were introduced into the combustion chamber of the apparatus described in the previous examples.

For preparing the mixture, oxygen, acetylene and nitrogen were supplied under a pressure of 1.9 kg/sq.cm.

Portion-wise cyclical filling of the combustion chamber with said explosive mixture was provided by feeding nitrogen as an inert gas under a pressure of 2.8 to 3.0 kg/sq.cm prior to igniting the explosive mixture.

A workpiece of stainless steel to be coated was preliminarily cleaned by the methods known in the art and then placed 160 mm from the open end of a detonation gun barrel.

The detonation rate was 4 times per second.

The thickness of the coating obtained after one explosion varied from 10 to 12 microns.

The strength of cohesion between the coating material and the workpiece material was 20±3 kg/sq.mm. Vickers microhardness under a load of 50 g was not less than 100 kg/sq.mm and porosity not more than 1%.

EXAMPLE 5

A mixture composed of acetylene and oxygen in the volume ratio of 1.0 to 1.1, respectively, to which nitrogen was added in the proportion of 20% of the total volume of said mixture, and a mixture of powdered titanium carbide (70% by weight) and powdered nickel (30% by weight) were fed to the combustion chamber of the apparatus described in the previous examples.

For preparing the mixture, oxygen, acetylene and nitrogen were continuously supplied under a pressure of 1.9 kg/sq.cm.

Portion-wise cyclical filling of the combustion chamber with said explosive mixture was effected by feeding nitrogen as an inert gas under a pressure of 2.8 to 3.0 kg/sq.cm prior to igniting the explosive mixture.

A workpiece of carbon steel to be coated was preliminarily cleaned by methods known in the art and then placed 170 mm from the open end of the detonation gun barrel. The detonation rate was 4 times per second.

The thickness of the coating obtained after one explosion varied from 5 to 8 microns.

The strength of cohesion between the coating material and the workpiece material was not less than 15 kg/sq.mm; Vickers microhardness under a load of 50 g was not less than 950 kg/sq.mm, and porosity not more than 1.5%.

The coating obtained by using the proposed method has better physical and chemical properties in comparision with the methods known in the art and can be employed in various branches of industry for protecting against corrosive and erosive wear under high-temperature conditions.

The method according to the invention can be accomplished by means of equipment which does not comprise a mixing chamber having distributing valves.

In addition, apart from the aforedescribed method of discontinuing the explosive mixture by means of an inert gas, such termination, in case of need, can be accomplished by means of some device, for instance a slide-valve, if the explosion mixture is continuously formed as indicated above.

What is claimed is:

1. A method of applying a powdered coating material to a substrate utilizing the explosive energy of combustion gases for ejecting the powdered material towards the substrate in a current cyclic operation comprising:

(a) continuously and constantly supplying to a mixing chamber a combustible gas and an oxidizing gas in a predetermined ratio during the coating process, thereby forming an explosive mixture.

(b) introducing portion-wise the powdered material, in a stream of an inert gas and said explosive mixture, freely into a combustion chamber of an apparatus for coating by detonation waves, the introduction of said coating material being synchronized with the operation cycle of said apparatus for coating;

(c) terminating the supply of explosive mixture to the combustion chamber solely by intorduction of an inert gas intermediate the mixing chamber and the combustion chamber at a pressure greater than that of the explosive mixture, thus preventing the flow of explosive mixture into the combustion chamber;

(d) igniting said explosive mixture in the combustion chamber to produce an explosion after a portion of the powdered material has been introduced completely into the combustion chamber.

* * * * *